United States Patent [19]

Acker, III et al.

[11] Patent Number: 4,844,184

[45] Date of Patent: Jul. 4, 1989

[54] LOCK DEVICE FOR HOLLOW STEM AUGERS

[75] Inventors: William L. Acker, III, Lenoxville; Leroy W. Janson, Clarks Summit; Richard Pirrami, Jessup, all of Pa.

[73] Assignee: Acker Drill Co., Inc., Scranton, Pa.

[21] Appl. No.: 250,547

[22] Filed: Sep. 29, 1988

[51] Int. Cl.[4] ..... E21B 17/046; F16L 37/14

[52] U.S. Cl. ..... 175/323; 285/404; 403/324; 403/362; 403/378

[58] Field of Search ..... 166/97.5, 83, 77.5; 175/323, 320, 321; 285/404, 330, 138, 139, 39, 91, 370; 403/378, 379, 362, 324, 288, 306, 408.1

[56] References Cited

U.S. PATENT DOCUMENTS

| | | | |
|---|---|---|---|
| 2,883,012 | 4/1959 | Hoffman | 403/408.1 |
| 2,939,727 | 6/1960 | Allen et al. | 285/404 X |
| 3,190,377 | 6/1965 | Rassieur | 175/323 X |
| 3,258,283 | 6/1966 | Winberg et al. | 403/379 |
| 3,356,393 | 12/1967 | Casanov | 403/362 X |
| 3,685,865 | 8/1972 | Young | 403/378 X |
| 3,796,448 | 3/1974 | Ringkamp | 175/323 X |
| 3,844,127 | 10/1974 | Koop, Jr. et al. | 403/378 X |
| 4,074,912 | 2/1978 | Van Bilderbeek et al. | 285/39 |
| 4,368,789 | 1/1983 | Orr et al. | 175/320 X |
| 4,610,517 | 9/1986 | Kukino et al. | 285/404 X |

*Primary Examiner*—Stephen J. Novosad

*Attorney, Agent, or Firm*—Nies, Webner, Kurz & Bergert

[57] ABSTRACT

A locking device or button for hollow stem auger couplings including an outer body section having an internal bore, a locking pin assembly mounted within the bore, and cooperating cam structure for moving the pin assembly a predetermined distance between locked and unlocked positions. Seal means at opposite ends of the bore keeps water and dirt out of the bore and protects the cam structure.

22 Claims, 2 Drawing Sheets

LOCK DEVICE FOR HOLLOW STEM AUGERS

BACKGROUND OF THE INVENTION

This invention relates generally to hollow stem augers for drilling a hole in the earth, sometimes several hundred feet deep, and keeping the hole open for other operations such as core sampling, ground water sampling, etc. Typically, the total auger length is formed by a plurality of tubular auger sections, each about five feet long, telescopically connected together at their adjacent ends by a drive shank and socket coupling assembly for transmission of rotary torque. Various lock devices have been used to lock the telescoping shank and socket ends of adjacent auger sections against axial separation, the most common type being a dog-point lock screw, such as screw 40*a* shown in U.S. Pat. No. 3,190,377 or Acker Drill Company lockscrew Part No. 130365. A screw of this type threads transversely through a tapped hole in the wall of the tubular socket end and has a dog-point that seats within an aligned drilled hole in the tubular shank end. These lockscrews function well when parts are new and clean. However, after use under corrosive, dirty, and abrasive conditions, the lockscrews frequently are frozen in place and difficult to remove when trying to separate the auger sections as they are withdrawn from the hole. The threads on the screw and in the wall of the auger section often become rusted and coated with dirt, and as the screw is turned in or out the threads in the tapped hole are damaged, and often destroyed, thus reducing the useful life of the auger section.

An alternative type of lock device is illustrated in U.S. Pat. No. 3,796,448. While this device addresses the problem of fluid leakage in the area of the coupling joint, it has not been totally successful in keeping water and debris out of the lock pin area and is not sturdy enough to withstand the heavy vibration and tortion loads produced during the drilling operation.

SUMMARY AND OBJECTS OF THE INVENTION

Accordingly, the primary object of this invention is to provide a novel locking device or button for hollow stem augers which overcomes the problems associated with the prior art, thereby reducing maintenance on and extending the useful life of the augers.

Another object of the invention is to provide a novel locking device for hollow stem augers which is readily interchangeable with the standard dog-point lockscrew and requires no modification of the auger itself.

Still another object of the invention is to provide a novel locking device as above, the device including an outer body having external threads which thread into the wall of the coupling socket and an internal bore, an inner locking pin assembly axially adjustably mounted within the bore, and seal means mounted within opposite ends of the bore to keep water and dirt out of the bore and to wipe the outer surfaces of the pin clean as it is moved in and out between locking and unlocking positions.

A further object of the invention is to provide the above novel locking device wherein the body and pin assembly have cooperating cam structure which produces a predetermined axial displacement of the pin as it is rotated within the body.

Still another object of the invention is to provide the above novel locking device, wherein the cam structure includes stop means which establishes the predetermined axial displacement and prevents the pin assembly from moving beyond the seal means in either direction of adjustment.

Other objects and advantages will become apparent as the description proceeds in connection with the accompanying drawings.

DETAILED DESCRIPTION OF THE INVENTION

Figure 1:
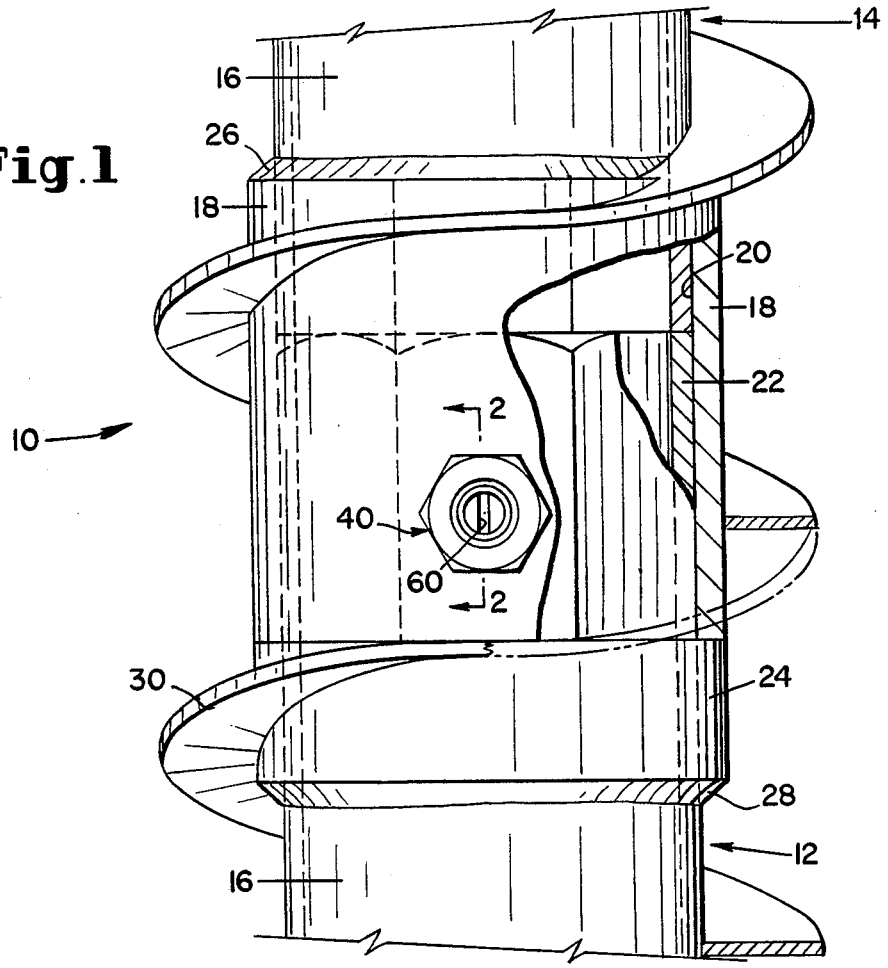
FIG. 1 is a fragmentary elevation view of a coupling joint of a hollow stem auger assembly employing the novel auger lock device or button of the invention.
Figure 4:
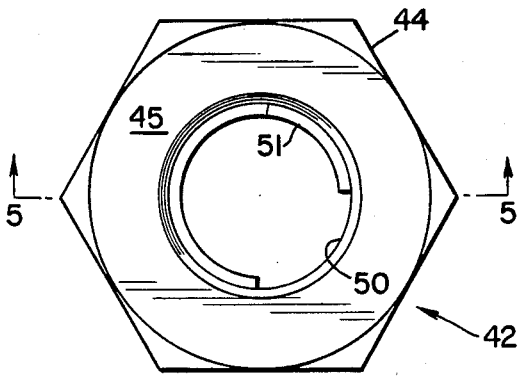
FIG. 4 is an outer end view taken along line 4—4 of FIG. 3.
Figure 3:
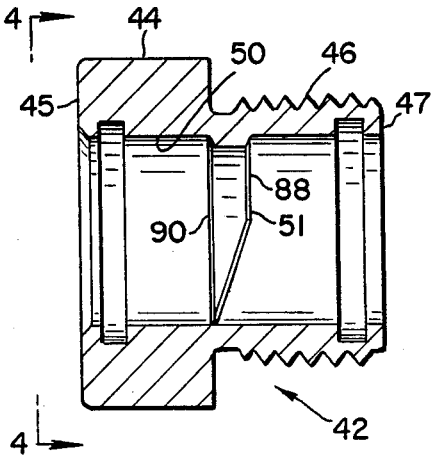
FIG. 3 is a fragmentary sectional view similar to FIG. 2, but illustrating only the fixed outer body of the device.

Referring now to the drawings, a typical auger assembly 10 for drilling a vertical bore hole, sometimes over a hundred feet deep, comprises a plurality of hollow stem auger sections such as sections 12 and 14 successively coupled together, each section being about five feet in length and identical in construction. Each section includes a pipe 16, a female socket member 18 having a bore 20 large enough to slip over one end of pipe 16, a male shank member having a tubular drive extension 22 fitting within bore 20 and projecting from flange 24 which slips over the other end of pipe 16. Socket member 18 and flange 24 are welded on opposite ends of pipe 16 at 26 and 28, respectively. Bore 20 and the outer surface of extension 22 are preferably formed e.g. by machining, with close-fitting, mating, eight-sided, octagonal drive surfaces for a strong drive connection and positive transmission of high torque loads during the drilling operation. The internal diameter of extension 22 corresponds to that of pipe 16, and its wall thickness commonly is one-quarter inch. Continuous screw segment 30 is formed along the outside diameter of pipe 16 in conventional fashion.

As shown in FIG. 1, the male drive extension 22 of a lower auger section 12 fits within bore 20 of socket 18 of the next to be added upper auger section 14. The bottom face of socket 18 seats against the opposing shoulder of flange 24 for direct transmission of vertical forces. Sections 12 and 14 are locked together against vertical axial separation as the auger sections are pulled out of the hole by one or more, preferably two, of the novel locking device or button 40 of the invention.

Referring to FIGS. 2 to 6, locking device 40 comprises an outer body section 42 and an inner locking pin assembly 43. Body section 42 has a hexagonal head portion 44, an external threaded portion 46 which threads into a conventional sized tapped hole 48 in the wall of socket 18, and a cylindrical bore 50 having an internal cam surface 51 formed therein.

Pin assembly 43 includes a bolt like member 52 having an inner circular head 54 and a reduced diameter shank 56 terminating in a threaded portion 58, the end of which is provided with a slot 60. An intermediate cam sleeve 62 has internal threads 64 and a counterbore 66, with threads 64 turning down on threads 58 so that face 68 seats flush against shoulder 55 of head 54. Sleeve 62 has a cam surface 70 formed on its outside diameter to mate and coact with cam surface 51. A nut 72 has threads 73 which turn down on threads 58 and a face 74 which seats flush against face 76 of sleeve 62. The outer diameters of head 54 and nut 72 are the same, and they closely fit in bore 50 with a few thousandths clearance. The outer diameter of sleeve 62 is a few thousandths less than head 54 and nut 72.

Figure 2:
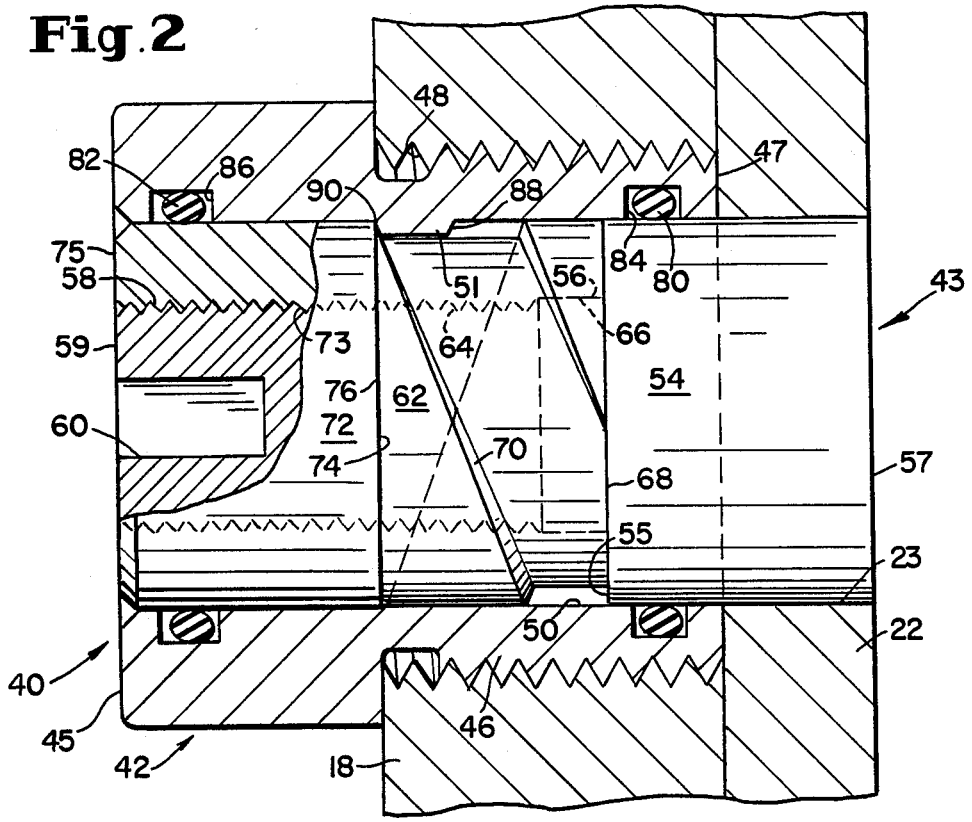
FIG. 2 is a fragmentary sectional view of the novel auger lock device taken along line 2—2 of FIG. 1, with the device in its lock position.
Figure 5:
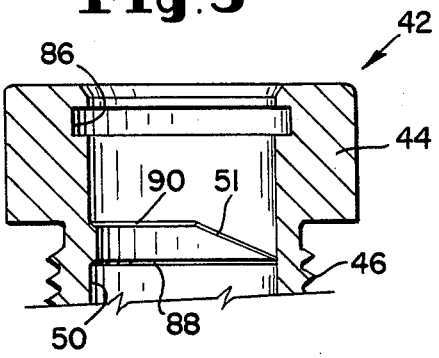
FIG. 5 is a fragmentary sectional view taken along line 5—5 of FIG. 4.
Figure 6:
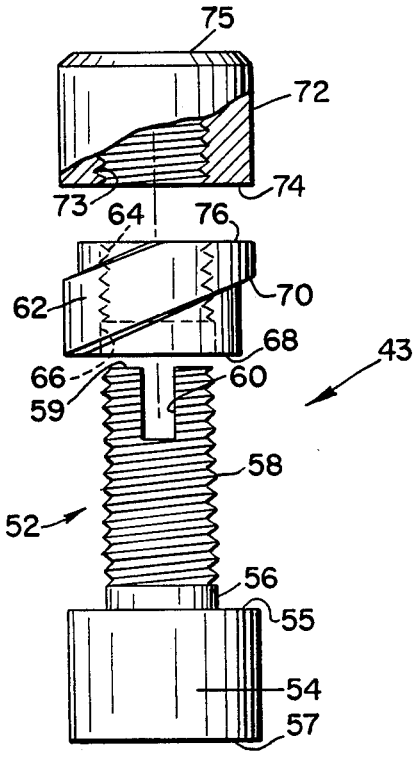
FIG. 6 is a fragmentary exploded view of the elements forming the inner adjustable locking pin assembly of the button.
Figure 7:
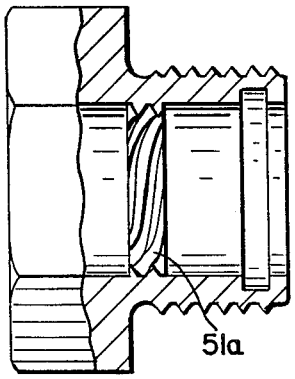
FIGS. 7 and 8 are fragmentary sectional views of alternate cooperating threaded cam structure formed on the body and adjustable pin assembly, respectively, by which the pin assembly is moved in and out as it is turned.
Figure 8:
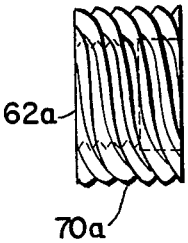

A pair of O-rings 80 and 82 are mounted in grooves 84 and 86, respectively, at the inner and outer ends of bore 50 and seal against the outside surfaces of head 54 and nut 72, respectively. The mating cam surfaces 51 and 70 are provided by machining a very coarse thread, e.g., a 2P-10° thread form, 0.245 wide. The components as shown in FIG. 2 are to proportional scale, but are about four times actual size. The thread cam surface 51 is faced on opposite sides 88 and 90 to about half thread width, or one-eighth inches wide, to furnish relief on one side of the thread. Alternatively, as shown in FIGS. 7 and 8 for more positive sturdy engagement mating cam surfaces 51*a* and 70*a* may be formed by machining a 0.50 inch lead, 7-start multiple, 0.0714 pitch thread form.

To assemble pin assembly 43 within body 42, cam sleeve 62 is threaded down onto shank 56 until face 68 seats against shoulder 55. With O-rings 80 and 82 in place in grooves 84 and 86, threaded portion 58 of bolt 52 is inserted from the inner end of body section 42 past O-ring 80 and cam surface 52 whereupon surface 70 engages and catches against surface 51. Bolt 52 is then turned so that surface 70 threads through surface 51 until shoulder 55 abuts against face 88.

The end of threaded portion 58 will be projecting beyond hex head 44 so that nut 72 may be threaded onto portion 58. A screw driver is placed into slot 60 to hold bolt 53, and the outer end of nut 72 is grasped with pliers and turned until face 74 is fully seated against face 76 and outer face 75 is flush with the outer end face 59 of portion 58. If necessary, the outer end of nut 72 may be filed to remove any burrs which might damage O-ring 82. As just described and assembled, pin assembly 43 would be in a fully retracted or unlocked position with shoulder 55 seated against face 88 and the inner end face 57 of head 54 flush with the inner end face 47 of body section 42. Flush faces 59 and 75 will be projecting beyond end face 45 of head 44.

During a drilling operation, after the next auger section 14 is coupled to the preceding section 12 by placing socket 18 down over drive extension 22, two locking devices or buttons 40 are installed on opposite sides of socket 18 to lock socket 18 and extension 22 against axial separation. Section 46 of body 42 is threaded into the transverse tapped hole 48 in the wall of socket 18 until head 44 tightly seats against the outer surface of socket 18. By placing a screw driver or other tool in slot 60, pin assembly 43 is then turned to advance head 54 inwardly via cam surfaces 51 and 70 into an aligned drilled hole 23 in extension 22 until it reaches its fully locked position established by face 74 seating against face 90. The outer end faces 45, 59, and 75 will be flush. Socket 18 and extension 22 are thus locked together.

As shown in FIG. 2, the various components of button 40 are sized and dimensioned so that shoulder 55 and face 74 in cooperation with faces 88 and 90, respectively, establish stop positions which limit the amount of axial displacement of pin assembly 43 from its locked position of FIG. 2 to its retraced unlocked position described above wherein socket 18 is axially removable from extension 22. The threaded cam surfaces formed as described with respect to surfaces 51 and 70, or 51*a* and 70*a*, are such that one-half turn of pin assembly 43 produces a desired one-quarter inch axial displacement of the assembly, and the axial distance between shoulder 55 and face 74 and their respective cooperating faces 88 and 90 are one-quarter inch. During the drilling operation, O-rings 80 and 82 prevent any water, dirt or other debris from entering the central portion of bore 50 and wearing or gumming up the cam surfaces 51 and 70, or 51*a* and 70*a*. Limiting the axial displacement of pin assembly 43 by way of the stop surfaces 55, 74, 88 and 90 ensures that head 54 and nut 72 can not ride beyond O-rings 80 and 82, respectively, regardless of how much a field operator tries to turn assembly 43.

In addition, the O-rings provide a cleaning, wiping action on the surfaces of head 54 and nut 72 as pin assembly 43 is moved between its locked and unlocked positions, again protecting and extending the life of the cam surfaces of button 40.

As discussed initially, the locking device or button 40 overcomes the problems associated with the conventional one-piece lockscrew. After body section 42 is initially installed as shown in FIG. 2, there is no need to remove threaded section 46 from tapped hole 48 each time drive extension 22 is uncoupled from socket 18. Consequently, damage to threads 48 is avoided and the useful life of the auger section is increased. The useful life of each locking device is substantially extended because of the sealed, protected environment provided for the operating cam surfaces by the O-rings 80 and 82. During use the outer diameter of nut 72 is protected within hex head 44 since end faces 59 and 75 are flush with end face 45. In addition, the locking pin assembly 43 and its positive thread cam construction are sturdy and rigid enough to withstand the vibrational forces present during a drilling operation. An especially convenient feature for the field operator lies in the fact that only a half turn of pin assembly 43 is required to retract head 54 to its unlocked position and free extension 22 axially from socket 18.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. In combination with two hollow auger sections, one of said sections having a tubular socket end and the other of said sections having a tubular shank end, said socket end telescopically receiving said shank end and said socket and shank ends having cooperating drive means by which said auger sections are rotated together, a transverse opening in said socket end, a locking device for locking said socket and shank ends together against axial separation, said locking device comprising an outer body means mounted within said transverse opening and having an internal bore, locking pin means mounted within said bore for movement between an inner locked position in which it locks said socket and shank ends together and an outer unlocked position in which said socket and shank ends are separable, cooperating adjusting means on said body means and said pin means for causing movement of said pin means between said locked and unlocked positions, and sealing means mounted at the inner and outer ends of said bore for sealing engagement with said locking pin means.

2. The combination of claim 1, said cooperating adjusting means comprising cooperating cam means and stop means associated therewith for establishing a predetermined amount of axial displacement of said pin means in said bore as said pin means moves between locked and unlocked positions.

3. The combination of claim 2, said cam means comprising mating thread means on said body means and said pin means operatively located within the central portion of said bore between said sealing means.

4. The combination of claim 3, said thread means being formed so that a predetermined rotation of said pin means produces said predetermined axial displacement, said stop means being operatively positioned in correlation with said predetermined rotation and axial displacement.

5. The combination of claim 4, said thread means being formed so that said predetermined rotation is an approximate half turn of said pin means.

6. The combination of claim 5, said thread means being a 2-pitch thread formation.

7. The combination of claim 5, said thread means being a 0.50 inch lead, multi-start thread formation.

8. The combination of claim 3, said locking pin means comprising a member having an inner head located adjacent the inner end of said bore and a reduced diameter shank portion extending outwardly from said head through said bore, intermediate sleeve means mounted on said shank against said head, outer nut means fastened on said shank against said sleeve means, said cam means being mating thread means formed on the outer surface of said sleeve means and the inner surface of said bore.

9. The combination of claim 8, said shank portion having threads and said sleeve means and said nut means being threaded onto said shank portion.

10. The combination of claim 8, wherein slot means is provided in the end face of said shank portion.

11. The combination of claim 1, said sealing means comprising a pair of O-rings.

12. A locking device adapted to lock together a tubular socket having a transverse opening therein and a shank telescopically received within the socket, said locking device comprising an outer body means adapted to be mounted within the transverse opening and having an internal bore, locking pin means mounted within said bore for movement between and inner locked position in which it locks the socket and shank together and an outer unlocked position in which the socket and shank are separable, cooperating adjusting means on said body means and said pin means for causing movement of said pin means between said locked and unlocked positions, and sealing means mounted at the inner and outer ends of said bore for sealing engagement with said locking pin means.

13. The locking device of claim 12, said cooperating adjusting means comprising cooperating cam means and stop means associated therewith for establishing a predetermined amount of axial displacement of said pin means in said bore as said pin means moves between locked and unlocked positions.

14. The locking device of claim 13, said cam means comprising mating thread means on said body means and said pin means operatively located within the central portion of said bore between said sealing means.

15. The locking device of claim 14, said thread means being formed so that a predetermined rotation of said pin means produces said predetermined axial displacement, said stop means being operatively positioned in correlation with said predetermined rotation and axial displacement.

16. The locking device of claim 15, said thread means being formed so that said predetermined rotation is an approximate half turn of said pin means.

17. The locking device of claim 16, said thread means being a 2-pitch thread formation.

18. The locking device of claim 17, said thread means being a 0.50 inch lead, multi-start thread formation.

19. The locking device of claim 14, said locking pin means comprising a member having an inner head located adjacent the inner end of said bore and a reduced diameter shank portion extending outwardly from said head through said bore, intermediate sleeve means mounted on said shank against said head, outer nut means fastened on said shank against said sleeve means, said cam means being mating thread means formed on the outer surface of said sleeve means and the inner surface of said bore.

20. The locking device of claim 19, said shank portion having threads and said sleeve means and said nut means being threaded onto said shank portion.

21. The locking device of claim 20, wherein slot means is provided in the end face of said shank portion.

22. The locking device of claim 19, said sealing means comprising a pair of O-rings sealing against said inner head and said outer nut means.

* * * * *